US005786542A

United States Patent [19]

Petrovich et al.

[11] Patent Number: 5,786,542

[45] Date of Patent: Jul. 28, 1998

[54] ANTI-PERSONNEL MINE CLEARING SYSTEM

[75] Inventors: Paul A. Petrovich, Fowlerville; John J. Schimtz, St. Clair Shores; Jack G. Rodgers, Roseville; Israel M. Grinwald, Bloomfield, all of Mich.

[73] Assignee: The United States of America as represented by the Secretary of the Army, Washington, D.C.

[21] Appl. No.: 745,517

[22] Filed: Nov. 4, 1996

[51] Int. Cl.[6] ..... F41H 11/12

[52] U.S. Cl. ..... 89/1.13; 89/1.11

[58] Field of Search ..... 89/1.13, 1.11

[56] References Cited

U.S. PATENT DOCUMENTS

| | | | |
|---|---|---|---|
| 2,242,808 | 5/1941 | Austin | 89/1.13 |
| 2,261,933 | 11/1941 | Flynn | 89/1.13 |
| 2,455,636 | 12/1948 | Woolson | 89/1.13 |
| 2,509,163 | 5/1950 | Musselman | 89/1.13 |
| 4,723,473 | 2/1988 | Girswald | 89/1.13 |
| 4,909,128 | 3/1990 | Griswald | 89/1.13 |
| 5,007,325 | 4/1991 | MacWatt | 89/1.13 |
| 5,442,990 | 8/1995 | Krohn | 89/1.13 |

FOREIGN PATENT DOCUMENTS

| | | | |
|---|---|---|---|
| 909874 | 5/1946 | France | 89/1.13 |

*Primary Examiner*—Michael J. Carone
*Assistant Examiner*—Theresa M. Wesson
*Attorney, Agent, or Firm*—Peter A. Taucher; David L. Kuhn

[57] ABSTRACT

A system for clearing anti-personnel mines includes a vehicle, a blast shield on the front of the vehicle, and arms pivoted to the blast shield. A roller wheel subassembly is connected to the arms by cables or chains. Cross members fastened diagonally between the arms minimize side to side swing of the arms on the blast shield while allowing the arms to swing up and down relative to each other. The vehicle has a boom for lifting the arms and roller wheel subassembly. The arms connect to the boom by another chain or cable that slides through an eye on the boom so that the chain or cable accommodates relative vertical swing of the arms. The roller wheel subassembly has an axle and roller wheels on the axle, the inner diameter of the roller wheels being greater than the axle's diameter. Annular spacers on the axle alternate with the wheels, the spacer diameters being larger than the wheels' inner diameters but smaller than the wheels' outer diameters. The wheels and spacers move independently of one another rotationally and radially relative to the axle.

7 Claims, 5 Drawing Sheets

ANTI-PERSONNEL MINE CLEARING SYSTEM

GOVERNMENT USE

The invention described here may be made, used and licensed by or for the U.S. Government for governmental purposes without paying us royalty.

BACKGROUND AND SUMMARY

During U.S. Army operations in recent years, American troops have encountered vast numbers of anti-personnel mines in areas where it is undesirable to use conventional mass mine clearing equipment. Such equipment is typically a tank with a large flail, rake or mine roller attached to the front of the tank. This equipment is unnecessarily large, heavy and expensive for anti-personnel mine removal. It is also difficult to transport and difficult to maneuver in many settings where anti-personnel mines are laid.

We have invented a mine clearing system that addresses the foregoing problems and is resistant to damage despite its relatively low weight and small size. Our system includes a standard light weight military vehicle accommodating an anti-personnel mine roller assembly. The front of the vehicle has a blast shield on which arms of the mine roller assembly pivot, and a roller wheel subassembly connects to the arms by cables or chains. Cross members fixed between the arms minimize the arms' lateral swing on the blast shield but the swinging ends of the arms can be vertically separated by as much as several feet, whereby the wheels of the roller wheel subassembly can better maintain contact with the ground. The vehicle has a boom for lifting the arms and roller wheel subassembly. The arms are connected to the boom by a chain or cable that can slide through an eye on the boom so that the chain or cable accommodates relative vertical swing of the arms. The roller wheels of the subassembly have larger inner diameters than their axle's outer diameter. The wheels all move independently, whereby they track over irregularities in the ground over which the roller wheel subassembly passes.

DETAILED DESCRIPTION

Figure 1:
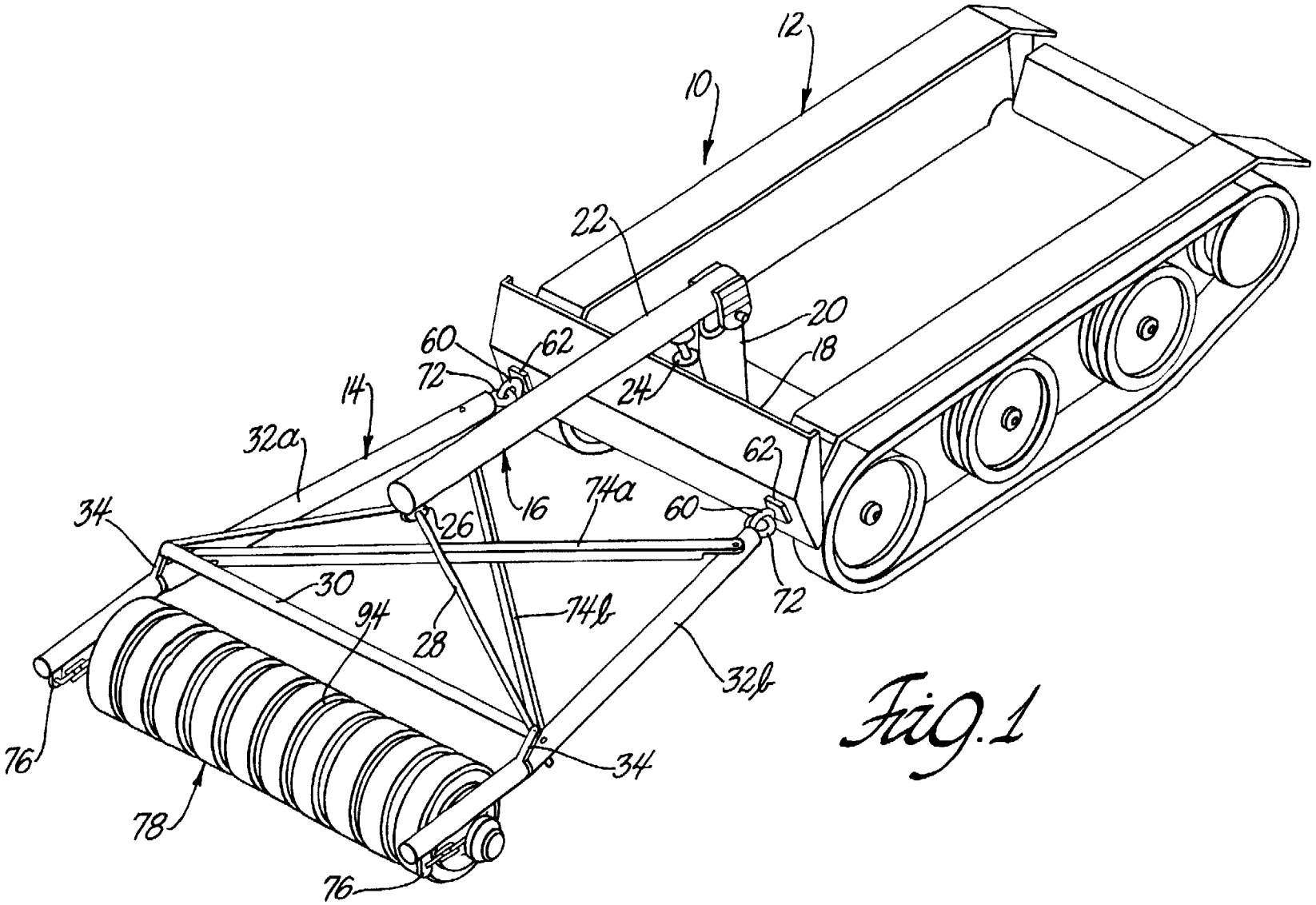
FIG. 1 is a perspective view of our anti-personnel mine clearing system.

In FIG. 1 is personnel mine clearing system 10 having a vehicle 12 and a mine roller assembly 14. For vehicle 12 we used a Hawk Loader Transporter XM501, known, relatively small utility vehicle used to load missiles onto aircraft. We prefer the Hawk Loader Transporter because it is a surplus item and can be acquired by U.S. military commands at little cost. For convenience, only the chassis of vehicle 12 is shown. The main modification to the Hawk Loader Transporter is removal of most missile handling components and the addition of 800 pounds of weight at the rear of the vehicle to counterbalance the weight of mine roller assembly 14. The total weight of vehicle 12 is 4800 pounds and mine roller assembly 14 weighs about 1700 pounds. A remaining component that was used to manipulate missiles is lifting boom 16, which is used in conjunction with mine roller assembly 14. Additionally, vehicle 12 is modified to be remotely controlled.

Boom 16 and blast shield 18 are connections between vehicle 12 and mine roller assembly 14. Boom 16 comprises upright post 20 fixed to vehicle 12 and boom arm 22 pivotally mounted on post 20. A hydraulic cylinder 24 is connected between vehicle 12 and boom arm 22, and the cylinder's actuation raises and lowers boom arm 16. At the forward end of boom arm 16 is an eye 26 through which passes a cable 28, which optionally can be replaced by a chain or a strong flexible line. Cable 28, a chain or a flexible line are all examples of nonrigid means to connect the arms to boom 16. Cable 28 passes through the ends of rigid transverse bar 30 and fastens by any suitable means to arms **32*a* and 32*b* of mine roller assembly 14. In the alternative, cable 28 can be fixed at or near its ends to transverse bar 30 while cable segments, as at 34, fasten to the ends of bar 30 and to arms 32*a* and 32*b***.

During mine clearing operations, boom 16 is lowered enough so that wheels 92 roll over the ground and cable 28 is slack. Arms **32*a* and 32*b* preferably space roller wheel subassembly 78 five to ten feet forward of vehicle 12 so that mines exploded by wheels 92 do not harm vehicle 12. It is contemplated that vehicle 12 will traverse a mine field at about five feet per second and that subassembly 78 will be spaced seven feet ahead of vehicle 12. Hence, mines exploding as much as one second after subassembly 78 rolls over them will not explode directly under vehicle 12. When vehicle 12 is travelling but not clearing mines, boom 16 raises mine roller assembly 14** off the ground.

Figure 6:
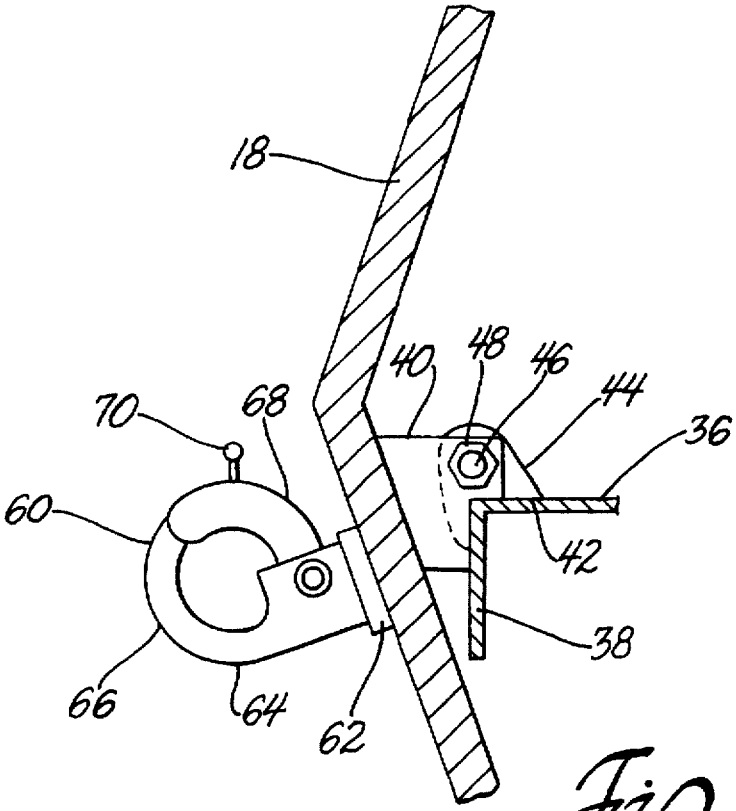
FIG. 6 is a detail view showing the how a blast shield connects to the vehicle and to the aforementioned arms.

The structure by which shield 18 connects vehicle 12 to mine roller assembly 14 is best seen in FIG. 6, which shows a shelf 36 at the forward end of the vehicle. Fixed to the forward edge of shelf 36 and forming a corner therewith is a valence panel 38. Fixed to both shelf 36 and panel 38 is an apertured mounting bracket 44 typical of those on forward exterior surfaces of U.S. military vehicles. An apertured adaptor plate 40 defines a step 42 which conforms to the corner formed by shelf 36 and panel 38, plate 40 being welded or otherwise fixed to the back side of shield 18. A bolt 46 fitting closely with bracket 44 and plate 40 passes therethrough and is held in place by a conventional nut 48. Because of bolt 46 and the conformance of step 42 with the corner formed by shelf 36 and panel 38, plate 40 is fixed to shelf 36 and panel 38 and shield 18 is fixed relative to vehicle 12.

Figure 3:
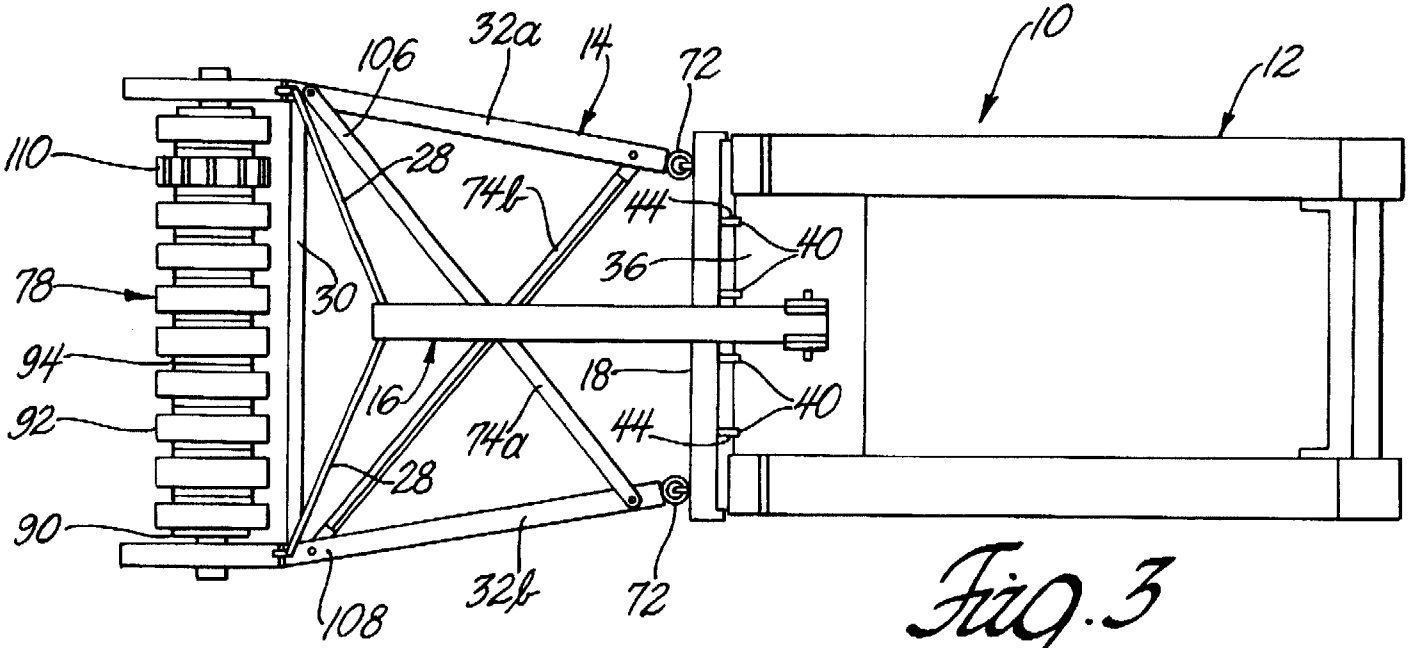
FIG. 3 is a plan elevational view of the system.
Figure 4:
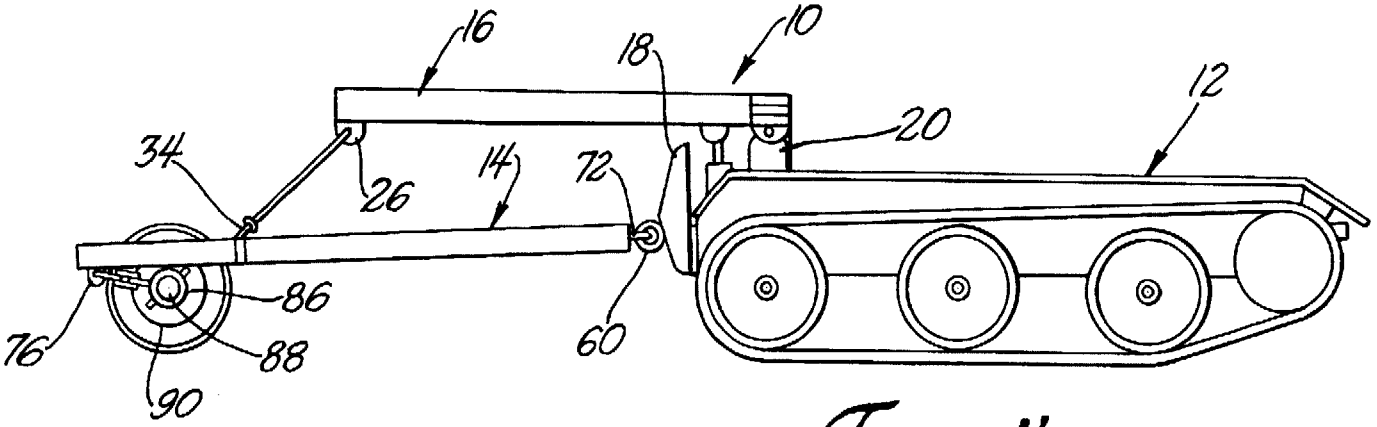
FIG. 4 is a side elevational view of the system.

Typical location and transverse spacing of adapter plates 40 on shelf 36 is shown in FIG. 3. The typical locations of mounting brackets 44 is also shown, these mounting brackets normally being adjacent the transversely outermost adapter plates.

Figure 7:
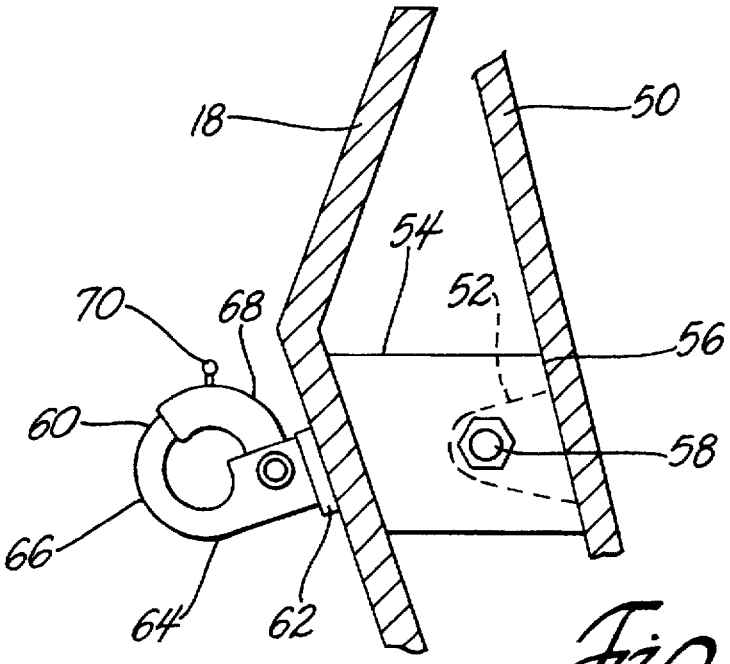
FIG. 7 is an alternate of the structure shown in FIG. 6.

FIG. 7 shows another example of a mounting bracket and an adapter plate used to affix shield 18 to a vehicle. There, a forward plate or structural panel 50 of a vehicle has a mounting bracket 52 affixed thereto. Adapter plate 54 is affixed to shield 18 and has an edge 56 abutting conformingly against panel 50. Bolt 58 through plate 54 and bracket 52 cooperates with edge 56 to fix plate 54 relative to panel 50, whereby shield 18 is fixed to the vehicle of which panel 50 is part.

As can be seen in FIG. 1, conventional mounting rings 60 are affixed the forward face of shield 18, these rings being shown in greater detail in FIGS. 6 and 7. Ring 60 has a base 62 by which the ring is welded or bolted to shield 18, and ring 60 has a body portion 64 adjacent base 62. A longer arcuate ring portion 66 is fixed to body portion 64 and a shorter arcuate ring portion 68 is pivoted to body portion 64. The arcuate portions are locked together by a lock mechanism (not shown) actuated by lever 70.

Again referring to FIG. 1, arms 32*a* and 32*b* are connected to one another by diagonal cross members 74*a* and 74*b*. Cross member 74*a* is affixed at its respective ends to the tops of arms 32*a* and 32*b* whereas cross member 32*b* is affixed at its respective ends to the bottoms of arms 32*a* and 32*b*. Due to the cross members, the arms can move little or naught horizontally relative to one another. Cross members 74*a* and 74*b* are flexible, vertically spaced apart and are not connected together, thereby allowing the arms to vertically swing about mounting rings 60. The the vertical distance between the outer, or swinging, ends of the arms can become as much as several feet. As arms 32*a* and 32*b* rise or lower relative to each other, cable 28 slides through eye 26 and thereby accommodates the arms' relative movement.

Eyes or lunettes 72 are fixed to the aft ends of arms 32*a* and 32*b*, and these lunettes engage mounting rings 60. Preferably, the inner diameter of lunettes 72 is just large enough so lunettes 72 can be placed on arcuate portion 66 of mounting ring 60 when arcuate portion 68 is swung open. Such an inner diameter of lunettes 72 acts with cross members 74*a* and 74*b* to minimize the horizontal or side to side swing of arms 32*a* and 32*b* about mounting rings 60, but lets the arms swing vertically.

Figure 2:
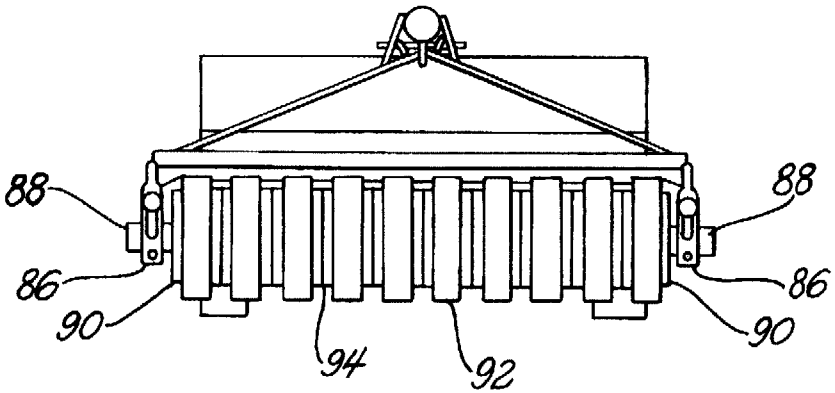
FIG. 2 is a front elevational view of the system.
Figure 5:
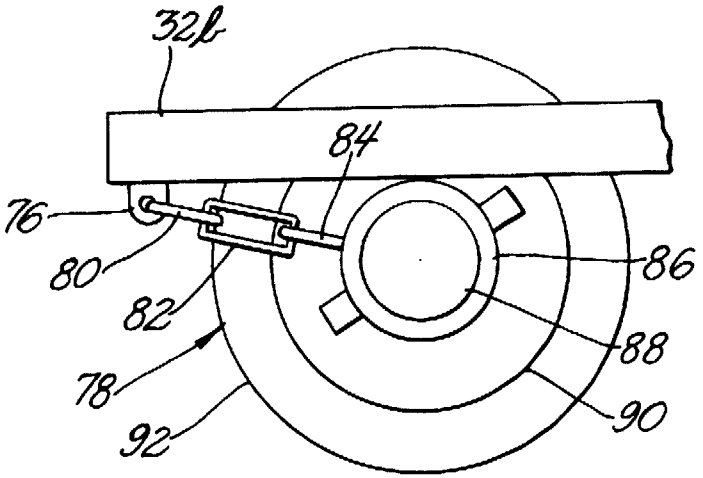
FIG. 5 is a detail view of the connection between an arm of the system and a roller wheel subassembly of the system.

At the fore end of arms 32*a* and 32*b* are eyes 76 from which freely depends roller wheel subassembly 78. As perhaps best seen in FIG. 5, links 80, 82 and 84 connect eyes 76 to roller wheel subassembly 78 so that subassembly 78 swings about eye 76. Link 84 attaches to a collar 86 which is fixed on axle 88 but which is not attached directly to arms 32*a* or 32*b*. As seen in FIG. 2, disks 90 at either end of axle 88 are fixed to, and optionally are integral with, collars 86. Disks 90 retain ring-like wheels 92 and ring-like spacers 94 on axle 88.

Figure 9:
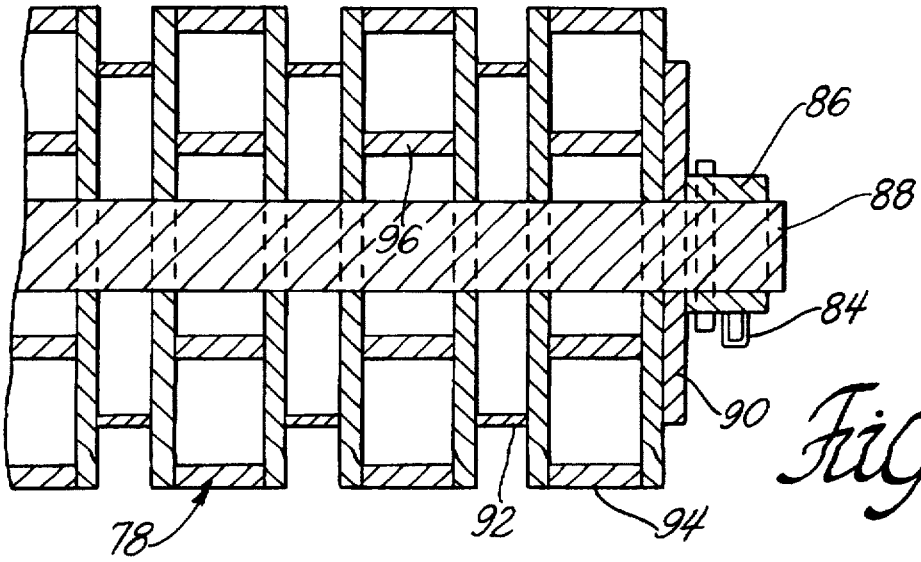
FIG. 9 is a partial sectional view of the roller wheel subassembly.

Details of subassembly 78 are shown in the radial sectional view of FIG. 9, where the outer diameter of axle 88 is much smaller than the inner diameter 96 of wheels 92, the axle's outer diameter typically being about one-half the wheels' inner diameter. Spacers 92 are of an annular band-like construction whose inner and outer diameters are both larger than the wheels' inner diameter; the inner and outer diameters of the spacers are also both smaller than the wheels' outer diameter. Wheels 92 and spacers 94 rotate independently of each other around axle 88 and also move radially relative to axle 88 independently of each other.

Wheels 92 are of a heavy rigid metal construction, the wheels each resembling a hollow torus in overall shape. The weight of the wheels is such that they press upon the ground with the same pressure as a soldier walking or running. The weight of wheels is also such that they press upon the ground with less force than vehicles such as trucks, armored personnel carriers or tanks. It is intended that the wheels will trigger mines intended for personnel but not mines intended for heavy vehicles. It is likewise intended that vehicle 12 will not trigger mines intended for heavy vehicles.

Figure 8:
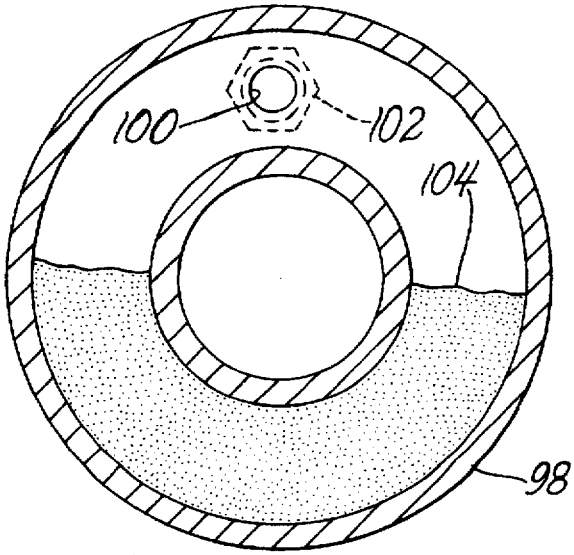
FIG. 8 is an alternate structure for a wheel of the roller wheel subassembly.

Shown in FIG. 8 is a wheel 98, which is the same as wheel 92 except that wheel 98 has bung hole 100 closed by removable plug 102 and has filler material 104 therein. The amount of material 104 depends on the added weight one desires to give to wheel 98. Material 104 can be water, oil, bee-bees, sand, pebbles or a mixture of a solid and liquid. We deem such materials to be "flowable" since they continuously flow to the bottom of wheel 98 as wheel 98 rolls. By using bee-bees or the like as filler material, wheel 98 is given a so-called "dead blow" effect similar to that of a dead blow hammer. That is, the blast force of an exploding mine upon wheel 98 will be dissipated somewhat by bee-bees compressing against one another or sliding against each other. As a consequence, a mine blast will be less likely to swing mine roller assembly 14 upward against boom 16 or to harm the mine roller assembly.

Figure 10:
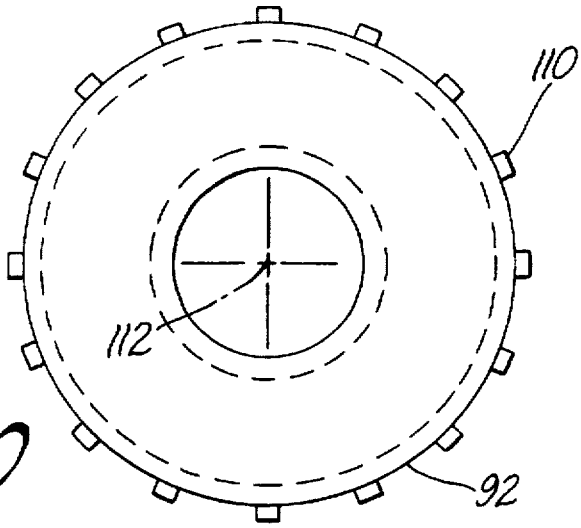
FIG. 10 is another alternate structure for a wheel of the roller wheel subassembly.

Shown in FIGS. 3 and 10 are elongate bar-like cleats 110 which are preferably oriented on the outer diametrical surface of wheels 92 parallel to axis 112 of wheel 92. Cleat width is typically one inch and the cleats extend completely across the wheel. The distance between cleats is less than the length of a soldier's foot and is typically a distance of four to six inches. Cleats provide a better grip between wheel 92 and the ground so that wheel 92 has a greater tendency to roll over the ground as opposed to skidding over the ground. Too, as cleats 110 engage the ground, they bear the weight of wheels 92 and concentrate that weight to a smaller area, or footprint, on the ground. The spacing and weight concentration of the cleats enhances the mine roller assembly's ability to trip anti-personnel land mines over which it passes.

It may be preferred that certain parts of mine roller assembly 14 be sacrificial. That is, as mine roller assembly 14 swings up due to a mine explosion, these parts will break before assembly 14 harms or overturns vehicle 12 or becomes significantly damaged itself. Additionally, breaking of these parts will absorb a portion of the explosion's energy. Two of the sacrificial parts are the forward connections between respective cross bars 74*a* and 74*b* and respective arms 32*a* and 32*b*, the connections being at or near points 106 and 108 (FIG. 3). These connections will typically break at a force of twice the weight of mine roller assembly 14. Likewise, cable 28 and at least one of links 80 or 82 will break at a force of twice the weight of mine roller assembly 14, so that the cable and links are sacrificial parts too.

When mine roller assembly 14 swings up after a mine explosion, crossbars 74*a* and 74*b* contact boom 16 and then break from arms 72*a* and 72*b*. If mine roller assembly 14 continues to swing up, cable 28 will tighten and then fail. As assembly 14 continues further to swing upward, arms 32*a* and 32*b* approach a vertical position and roller wheel subassembly 78 exerts upward tension on links 80, 82 and 84. Then on each side one of links 80 or 82 will fail so that wheel assembly 78 flies upward but not backward toward vehicle 12.

We wish it to be understood that we do not desire to be limited to the exact details of construction or method shown herein since obvious modifications will occur to those skilled in the relevant arts without departing from the spirit and scope of the following claims.

What is claimed is:

1. A system for clearing mines from a mine field comprising:

a vehicle;

a forward surface of the vehicle;

mounting brackets on the forward surface;

a first arm;

a second arm;

means for pivotably and releasably connecting the arms to the vehicle, the arms able to swing upward about their connections to the vehicle;

means for minimizing side to side swing of the arms about the connecting means while allowing the arms to swing up and down relative to each other;

a roller wheel subassembly connected to the arms;

an axle of the roller wheel subassembly;

a set of roller wheels surrounding the axle, the roller wheels having an inner wheel diameters greater than an axle diameter; and annular spacers surrounding the axle and alternated with the wheels, diameters of the spacers being larger than the inner wheel diameters but smaller than outer wheel diameters, wherein the wheels and spacers move independently of one another angularly and radially relative to the axle.

2. The system of claim 1 further comprising means for imparting a dead blow effect to the roller wheels, the imparting means itself comprising:

torus shaped voids defined by the wheels; and flowable filler material in the voids.

3. A system for clearing mines from a mine field, comprising:

a vehicle;

a forward surface of the vehicle;

mounting brackets on the forward surface;

a first arm;

a second arm;

means for pivotably and releasably connecting the arms to the vehicle, the arms able to swing upward about their connections to the vehicle;

means for minimizing side to side swing of the arms about the connecting means while allowing the arms to swing up and down relative to each other; and a roller wheel subassembly connected to the arms;

wherein the minimizing means comprises a first cross member connected diagonally between the first arm and the second arm, the minimizing means further comprising a second cross member connected diagonally between the first arm and the second arm, the second cross member crossing over and spaced above the first cross member.

4. A system for clearing anti-personnel land mines from a mine field, comprising:

a vehicle;

a forward surface of the vehicle;

mounting brackets on the forward surface;

a blast shield at the forward surface;

adapter elements fixed to the blast shield, engaged to the brackets and having surface contact with the forward surface;

a first arm;

a second arm;

means for pivotably and releasably connecting the arms to the blast shield, the arms able to swing upward on the blast shield;

means for minimizing side to side swing of the arms about the connecting means while allowing the arms to swing up and down relative to each other, the minimizing means comprising a first flexible cross member connected diagonally between the first arm and the second arm, the minimizing means further comprising a second flexible cross member connected diagonally between the first arm and the second arm, the second cross member crossing over and spaced above the first cross member;

a boom on the vehicle;

an eye on the boom;

first nonrigid means for connecting the arms to the boom, the nonrigid means passing slidably through the eye;

a roller wheel subassembly;

second nonrigid means for connecting the roller wheel subassembly to the arms;

an axle of the roller wheel subassembly;

a set of roller wheels surrounding the axle, the roller wheels having inner wheel diameters greater than an axle diameter and;

annular spacers surrounding the axle and alternated with the wheels, diameters of the spacers being larger than the inner wheel diameters but smaller than outer wheel diameters, wherein the wheels and spacers move independently of one another angularly and radially relative to the axle.

5. The system of claim 4 further comprising means for imparting a dead blow effect to the roller wheels, the imparting means itself comprising:

voids defined by the wheels and;

filler material in the voids.

6. The system of claim 4 further comprising means to for concentrating roller wheel pressure upon a mine field surface, the concentrating means itself comprising bar-like cleats on outer diametrical surfaces of the roller wheels, the cleats parallel to axes of the roller wheels.

7. The system of claim 4 wherein the first nonrigid means, the second nonrigid means and connections between the arms and the cross members are sacrificial elements weaker than other elements of the system, the sacrificial elements breaking under predetermined forces.

* * * * *